US005239096A

United States Patent [19]

Rohdenburg et al.

[11] Patent Number: 5,239,096

[45] Date of Patent: Aug. 24, 1993

[54] DEGUMMING PROCESS FOR PLANT OILS

[75] Inventors: Herbert L. Rohdenburg, Hamburg, Fed. Rep. of Germany; Karoly Csernitzky, Szolnok, Hungary; Bela Chikany, Budapest, Hungary; Jozsef Peredi, Budapest, Hungary; Attila Borodi, Budapest, Hungary; Anna F. Ruzics, Budapest, Hungary

[73] Assignee: Krupp Maschinentechnik GmbH, Essen, Fed. Rep. of Germany

[21] Appl. No.: 748,660

[22] Filed: Aug. 22, 1991

[30] Foreign Application Priority Data

Aug. 23, 1990 [HU] Hungary ..... 5292/90

[51] Int. Cl.[5] ..... C11B 3/00

[52] U.S. Cl. ..... 554/176; 554/179; 554/204; 554/207

[58] Field of Search ..... 260/403, 424; 554/176, 554/204, 207

[56] References Cited

U.S. PATENT DOCUMENTS 4,049,686 9/1977 Ringers et al. ..... 260/424
4,698,185 10/1987 Dijkstra et al. ..... 260/403

FOREIGN PATENT DOCUMENTS 0099201 1/1984 European Pat. Off. .
0195991 1/1986 European Pat. Off. .
0269277 6/1988 European Pat. Off. .
0456300A1 11/1991 European Pat. Off. .
7929420 6/1980 France .

*Primary Examiner*—José G. Dees
*Assistant Examiner*—Deborah D. Carr
*Attorney, Agent, or Firm*—Herbert Dubno

[57] ABSTRACT

A method of removing gums which cannot be removed by simple water degumming from plant oils having the following steps:

(a) adding to a plant oil containing gum substances not hydratable with water and wax substances, substantially 0.01 to 0.08% of a food acid or an acid anhydride of a food acid in a 5 to 15% solution thereof at a temperature of 20° to 70° C., intimately mixing the oil and the solution and causing the oil and the solution to remain in contact for a contact time in excess of 5 minutes with slow stirring;

(b) to a mixture formed in step (a) adding a 1 to 5% solution of a base at a temperature of 10° to 40° C. in an amount between 40 and 150% of the amount stoichiometrically required for neutralization to the acid added to the mixture in step (a) and effecting a reaction in the mixture for a period of 1 to 4 hours under slow stirring to effect coagulation of at least a major portion of the gum substances and optionally reducing a content of high melting triglycerides and wax substances in the mixture;

(c) rapidly and briefly heating the mixture formed in step (b) to separating an oil component from a component precipitated therefrom; and (d) optionally washing the oil component with a small quantity of water.

9 Claims, No Drawings

DEGUMMING PROCESS FOR PLANT OILS

FIELD OF THE INVENTION

Our present invention relates to a process for reducing in, plant oils or so-called edible oils, the content of gum substances which are no longer hydratable by water, i.e. which cannot be removed by water degumming processes and to a process of this type which can simultaneously reduce the wax content of plant oils.

BACKGROUND OF THE INVENTION

In the recovery of crude plant oils from the raw materials, phosphorous-containing compounds, namely phosphoglycerides and phosphosphyngolipids customarily are found in the plant oil. Such substances, referred to generally as gum substances or phosphatides derive from the cells of the raw material and pas into the oil during the oil extraction process.

Such compounds play a role in the life processes of the plant, for example in the formation of the lipoprotein cell membranes, in food synthesis, in fatty-acid metabolism and in other processes which take place within the cells.

The quantities of these substances which can be found in the plant oil fluctuate depending upon the characteristics of the raw plant materials and the technology used for oil recovery. They may make up between 3.0 and 0.5% by weight of the plant oil.

In spite of their presence in relatively small quantities, their composition may be complex. For example, the principal proportion of such gum substances may be constituted from at least 10 to 12 compounds, which is not surprising since such materials have a variety of functions in the cells and hence a multiplicity of compounds can be expected to be present in this phosphatide component.

The multiplicity of compounds present in the phosphatide component means that some of the component will have different properties than others. For example, most of these compounds are hydratable by water. They form lyotropic phases and are swellable so that they can be readily separated in a gel form from the plant oil by water degumming techniques.

The phosphatides also contribute to the cloudiness of the plant oil and precipitate formation. They may disturb further oil refining processing steps and hence removal of them is necessary. The removal of so-called hydratable gums can be effected by a treatment with water or steam, swelling or hydration with subsequent separation, usually by centrifugation. These process steps are referred to generally as aqueous degumming or water degumming.

The gumming substances present in the plant oil, however, also include compounds which are not hydratable in the presence of the water molecule and thus remain in the oil after water degumming.

The amount of so-called nonhydratable gums or gum substances, depending upon the nature of the water degumming process which is carried out, can amount to about 0.15 to 0.20% by weight of the plant oil or between 5 and 30% of the total gum substances originally present. Removal of such nonhydratable gums requires special methods.

It has been found to be important that even these relatively small amounts of nonhydratable gums be reduced in the course of further refining of the oil and deodorizing so that the remaining gum substances are present in a total concentration which is as much as possible reduced below 0.01% to avoid problems in the deodorizing apparatus and with the raffinate quality. This is especially important since the gummy substances are not significantly thermally stable and can undergo polymerization and cracking at the customary deodorizing temperatures which can exceed 200° C. The decomposition products of phosphatides remaining in the raffinate also detrimentally affect the taste of the fully refined oil.

In the classical chemical refining processes in which the free fatty acids are neutralized with alkali and are removed in the form of soaps which can be washed from the oil, the gum substance content can be reduced to about 0.015 to 0.03%. The requisite further reduction can be effected in the bleaching stage before the subsequent deodorization.

Because of the increasing significance of physical refining processes which are being practiced to a greater extent for greater numbers of oils, the degumming is followed by bleaching and a distillative deacidification and deodorization.

The requisite elimination of the remaining gum substances after the water degumming step can thus be achieved, only with increased use of bleaching earth and thus at a significant cost increase. It is, therefore, of great importance to be able to reduce the gum substance content in the initial stages of refining.

There has been considerable research into the nature of these nonhydratable compounds: (K. Nielsen: Dissertation Copenhagen 1956; B. Braae, U. Brimberg and N. Nyman: J. Am. Oil Chem.Soc., 34, 1957, 293; A. Hvolby: Femte Nordiska Fettsymposiet, Tyringe, 1969, 338–351; C. R. Scholfield, H. J. Dutton et al: J. Am. Oil Chem.Soc., 25, 1948, 368–372, etc.).

The most significant conclusions are that in contrast to the hydratable gums, whose phosphatide molecules have a highly polar component, for example, choline, ethanolamine, serine and, inosite, the nonhydratable gums do not have these polar portions and are constituted primarily of the calcium and magnesium salts of the phosphatidic acids and the lysophosphatidic acids. Of course the salt formation can also take place with other cations, for example iron, copper and aluminum.

Based upon their structure, such nonhydratable phosphatides can be removed, according to the literature, by a variety of processes. These processes have been found to be successful for elimination of the majority of the compounds which are nonhydratable with water.

One such process as described in German open application DE-OS 26 09 705 treats the oil with acid or acid anhydride and subsequently with water. In U.S. Pat. No. 4,049,686 the oil is also treated with acid and the oil/acid mixture is subjected to washing out of the acid and 0.5 to 3% water is added to the acid-reacted phosphatide.

As in the more recent European patent publication 0 195 991, the removal by this process of metallic impurities is not satisfactory and the efforts to remove nonhydratable phosphatides to the low levels required involve a variety of difficulties.

OBJECTS OF THE INVENTION

It is, therefore, the principal object of the present invention to provide an improved process for the removal of the nonhydratable phosphatides or gummy substances from plant oils whereby drawbacks of earlier methods are avoided.

Another object of the invention is to provide an improved process which permits a more complete degumming of plant oils and, possibly, a dewaxing thereof.

SUMMARY OF THE INVENTION

These objects and others which will become apparent hereinafter are attained, in accordance with the present invention in a process for the degumming of plant oils and particularly for removing nonhydratable gum substances from a plant oil, optionally with a dewaxing thereof, which comprises the steps of:

(a) adding to a plant oil containing gum substances not hydratable with water and wax substances, substantially 0.01 to 0.08% of a food acid or an acid anhydride of a food acid in a 5 to 15% solution thereof at a temperature of 20° to 70° C., intimately mixing the oil and the solution and causing the oil and the solution to remain in contact for a contact time in excess of 5 minutes with slow stirring;

(b) to a mixture as formed in step (a) adding a 1 to 5% solution of a base at a temperature of 10° to 40° C. in an amount between 40 and 150% of the amount stoichiometrically required for neutralization to the acid added to the mixture in step (a) and effecting a reaction in the mixture for a period of 1 to 4 hours under slow stirring to effect coagulation of at least a major portion of the gum substances and optionally reducing a content of high melting triglycerides and wax substances in the mixture;

(c) rapidly and briefly heating the mixture formed in step (b) to separate an oil component from a component precipitated therefrom; and (d) optionally washing the oil component with a small quantity of water.

Advantageously, the reaction time in step (b) is about two hours, and the slow stirring is effected at a speed of 20 to 40 $min^{-1}$. Most advantageously, the oil after separation is washed with the small amount of water and the brief heating step raises the temperature to 80° C.

The effect of the base is that the phosphatidic acids or lysophosphatidic acids are liberated and their cations (calcium, magnesium, iron, etc.) are dissociated so that hydration and separation from the oil can be effected. The use of base is described in British patent 1,565,569, in European patent publication 0 195 991 and in U.S. Pat. No. 4,698,185.

In two aspects, however, these processes have been found to be unsatisfactory. The critical aspect of the treatment is the question of care. Nowadays With all food stuffs, including edible oils, a minimum of chemical treatment must be observed.

It is, therefore, not only important to remove the nonhydratable phosphatides in an optimum manner, but it is also essential to minimize the chemical treatment of the plant oil. This was not done in the last-mentioned process. Indeed, these earlier processes using base, involved excess chemical treatment of the oil as well as chemical drawbacks in terms of the costs of the chemicals involved and the energy cost of the process.

After an aqueous degumming process, about 0.20% of nonhydratable phosphatides remain in the oil, i.e. 2,000 ppm. This nonhydratable phosphatide can be treated as completely in the form of Mg or Ca salts which would correspond to 110 ppm calcium if all the cations are reckoned as Ca. For the decomposition stoichiometrically, 190 ppm of $H_3PO_4$ or 380 ppm of citric acid required. This corresponds, in terms of the oil, to 0.02% or 0.04%.

Further research has shown that the calcium, magnesium and iron content of the water-hydratable oils is less than these values so that to achieve the desired effect, only a very small acid quantity of about 0.04 to 0.08% of the oil will suffice. Processes carried out with these quantities of acid have shown very good results even when these small amounts of acid are added in dilute solution, for example, 10 to 15% aqueous solution, the temperature is not raised above 70° C. during the acid-treatment process and the aqueous-acid solution is not admixed violently with the oil. As a consequence, according to the invention, we can use conditions which have no adverse effect on other characteristics of the oil.

Contrasting these conditions with earlier methods, we note that in British patent 1,565,569, high temperatures (95° C.) and the use of concentrated or 50% aqueous acid is required and the acid must be present in excess (more than 0.08% and up to, say 1.2%) and in the more highly concentrated form of 20 to 50% concentration with very violent stirring as in European patent publication 0 195 991. Such extreme conditions can be completely avoided With the present invention.

The process of the invention is effected for a longer period of time (10 to 15 minutes) than the contact time in the prior art process. However, since the apparatus used can be a closed apparatus, and a substantially lower temperature is employed, the effect of the treatment is far less detrimental to the plant oil which can be seen from the fact that the oxidation number or peroxide number of the oil is only minimally affected in an adverse manner if it is affected at all.

After the treatment with acid, a dilute (1 to 2%) aqueous solution of base (lye solution) is added to the oil, the oil being cooled to 20° to 40° C. prior to addition to the base. This treatment dissociates the phosphatidic acids and the lysophosphatidic acids. They are heated and ca be removed from the oil for the separation step. The possibility of separating out the gumming substances is substantially improved by the low temperature since the gummy substances are separated out from the oil in gel form. The low temperature also ensures that that treatment will not have a detrimental effect on the oil in other respects. For example, the oxidation characteristics of the oil are not detrimentally altered.

A further advantage of the low temperature is that, in the case of wax-containing oils and oils which contain triglycerides of high melting point, these are also separated out efficiently.

Practical tests have shown that the separation and possible crystallization of the higher melting triglycerides and waxes is usually hindered significantly by phosphatide compounds in the oil. Surprisingly, with the present invention, after the separation of the nonhydratable phosphatides by swelling, the aforementioned triglycerides and waxy substances can be separated from the oil in a short period of time.

The quantity of lye (aqueous base) which is used should be sufficient to neutralize the acid added to the oil according to the present invention.

With oils such as sunflower seed oil which can require a compulsive dewaxing, the degree of wax separation can be increased by reducing the temperature of the oil to 8° to 10° C. before the aqueous base is added.

The removal of wax substances together With the phosphatide substances can be improved by utilizing the absorption effect of soap micelles. In that case, the dilute base is provided in a slight excess so that a small part of the free acids always present in the oil will be neutralized and thus produce a small amount of soap, the micelles of which are available for absorption as indicated.

We have already indicated that, because of the relatively mild conditions with which the process of the invention is carried out, and particularly the low temperatures, the treatment does not result in a significant increase in the oxidative coefficients of the oil. This, of course, permits crystallization of waxy substances, it being known that oxidized fatty acids have crystallization-blocking tendencies.

For the separation of high-melting point triglycerides and waxy substances, it is advantageous to provide a so-called rest time or rest period which has been found in addition to optimize the separation of the phosphatides. As a consequence, the mixture of oil and acid is admixed, in turn, with the lye or aqueous base, after the addition of the lye, with very slow stirring or slow flow conditions for periods which optimally may range between 2 and 3 hours.

Thereafter, in a third step, separation of the phases is effected by suddenly and briefly raising the temperature of the mixture containing the basic solution and the oil so that spontaneous separation of the phosphatide and wax phase from the oil phase will result. The phases are then separated and the oil phase can be washed with a small quantity of condensed water.

The separated gum and wax phase is neutral from the point of view of its pH value and can be added to extraction residues or other animal feed or fodder products.

With the use of the invention, the amount of nonhydratable gum which remains present in the plant oil is significantly reduced by comparison with prior ar systems while the plant oil itself retains optimum characteristics, especially from the point of view of its oxidation characteristics. In other words, the oxidation values of the oil are not degraded to a significant degree.

The amounts of high-melting point triglycerides and wax in the oil are likewise reduced so that special dewaxing steps are no longer necessary or can be simplified. When the goal is a significant reduction of the wax content of the oil, the addition of excess base in small quantities to produce small amounts of soap can be helpful so that wax will also adsorb on the micelles.

The following examples demonstrate the use of the principles of the invention for the practically complete degumming of the oils used. As a consequence, any subsequent bleaching stages which may be required or advantageous, can be carried out with significantly less bleaching earth, thereby reducing the costs and increasing the efficiency.

EXAMPLE 1

The plant oil treated is sunflower oil, previously degummed with water, and having the following characteristics:

| | |
|---|---|
| Acid number | 1.5 |
| Peroxide number | 8.0 |
| Anisidine number | 0.9 |
| Phosphorous content | 75 ppm |
| Iron content | 1.00 ppm |
| Copper content | 0.04 ppm |
| UV absorption (232 nm) | 3.1 |
| Wax content | 0.06% |

In a plant-oil processor, the above-described oil is continuously heated to 50° C. and fed continuously with a 10% citric acid solution into a tank provided with a stirrer. Calculated as solid citric acid, for each 1000 kg of oil, 700 g of citric acid are added. The oils/acid mixture is slowly stirred for 15 minutes in a tank and then cooled to 30° C.

To this mixture is added an amount of 4% aqueous NaOH solution corresponding to the amount stoichiometrically required to neutralize all of the citric acid. The resulting mixture is slowly stirred for 2 hours in the tank and then suddenly heated to 80° C. and fed to a separator, e.g. a centrifugal separator.

The oil phase recovered from the separator is washed with 10% soft Water in another centrifugal separator. The washed oil is then dried or subjected to further refinement or supplied to an apparatus for the production of edible oils.

The ultrafine degummed oil which results has the following properties:

| | |
|---|---|
| Acid number | 1.5 |
| Peroxide number | 8.0 |
| Anisidine number | 1.0 |
| Phosphorous content | 2.5 ppm |
| Iron content | 0.1 ppm |
| Copper content | 0.01 ppm |
| UV absorption (232 nm) | 3.2 |
| Wax content | 0.04 |

After treatment with 1% bleaching earth, the phosphorous content is reduced to a value less than 1 ppm and the color of the oil corresponds to standard requirements for edible oils.

EXAMPLE 2

Water degummed sunflower oil of the following characteristics is used:

| | |
|---|---|
| Acid number | 1.2 |
| Peroxide number | 7.5 |
| Anisidine number | 0.7 |
| Phosphorous content | 80 ppm |
| Iron content | 0.9 ppm |
| Copper content | 0.05 ppm |
| UV absorption (232 nm) | 3.5 |
| Wax content | 0.05% |

In a continuously operating plant oil treatment apparatus, 15% aqueous citric acid is stirred into the plant oil at 40° C. For 1000 kg of oil, 400 g of solid citric acid was used in a 15% aqueous solution form described. After slow stirring for 15 minutes, the mixture is cooled to 25° C. Thereafter a 5% aqueous NaOH solution is added to the oil in an amount of 110% of that required to neutralize the citric acid. This mixture is stirred in the tank for a period of 2 hours and is then subjected to sudden heating to 80° C. and then supplied to a separator as described.

The oil phase recovered from the separator is washed with soft water in an amount of 19% on another separator. The washed oil is dried or subjected to further refinement. The significant characteristics of the degummed oil are as follows:

| | |
|---|---|
| Acid number | 1.0 |
| Peroxide number | 6.0 |
| Anisidine number | 1.0 |
| Phosphorous content | 4.5 ppm |
| Iron content | 0.08 ppm |
| Copper content | 0.01 ppm |
| UV absorption (232 nm) | 3.5 |
| Wax content | 0.03% |

EXAMPLE 3

Pressed sunflower oil with the following characteristics was used.

| | |
|---|---|
| Acid number | 1.3 |
| Peroxide number | 6.0 |
| Anisidine number | 0.1 |
| Phosphorous content | 150 ppm |
| Iron content | 5.0 ppm |
| Copper content | 0.05 ppm |
| UV absorption (232 nm) | 3.0 |
| Wax content | 0.07 g |

In a 1500 tank equipped with a stirrer, 1000 kg of the oil are heated to 50° C. in steps and then contacted first with soft water in an amount of 2% and then with a phosphoric acid solution in an amount of 10%. For 1000 kg of the oil, 700 g of phosphoric acid was used. The mixing was effected during stirring and after the addition of the acid, the mixture was stirred slowly for a further 20 minutes.

With continued mixing, a 5% aqueous NaOH solution was supplied in an amount sufficient for complete neutralization of the phosphoric acid used. Simultaneously the mixture is cooled to 30° C.

After further stirring for 2 hours, the mixture is flash-heated to 80° C. and supplied to a separator. After separation, the oil is twice washed with 10% water on two further separators and the washed oil is dried or subjected to further refining.

The characteristics of the end product are as follows:

| | |
|---|---|
| Acid number | 1.3 |
| Peroxide number | 7.1 |
| Anisidine number | 0.2 |
| Phosphorous content | 7.0 ppm |
| Iron content | 0.1 ppm |
| Copper content | 0.01 ppm |
| UV absorption (232 nm) | 3.0 |
| Wax content | 0.07 |

EXAMPLE 4

Water degummed rape-seed oil With the following characteristics is used:

| | |
|---|---|
| Acid number | 1.5 |
| Peroxide number | 8.5 |
| Anisidine number | 0.5 |
| Phosphorous content | 90 ppm |
| Iron content | 0.7 ppm |
| Copper content | 0.05 ppm |
| UV absorption (232 nm) | 2.1 |

1000 kg of the above-described oil is heated stepwise in a 1500 l tank provided with a stirrer to 40° C. Then a 15% aqueous phosphoric acid solution is added in an amount calculated on the basis of pure phosphoric acid of 0.05% and the oil and the mixture are slowly stirred for 20 minutes. Thereafter 5% aqueous NaOH is added in an amount stoichiometrically equivalent to the phosphoric acid for neutralization.

After slow stirring for an hour, the contents of the tank are suddenly heated to 80° C. and supplied to a separator. After separation, the oil is washed with soft water in an amount of 10%. The oil is dried or subjected to further refining. Characteristics of the end product are:

| | |
|---|---|
| Acid number | 1.5 |
| Peroxide number | 9.0 |
| Anisidine number | 0.5 |
| Phosphorous content | 9.0 ppm |
| Iron content | 0.5 ppm |
| Copper content | 0.01 ppm |
| UV absorption (232 nm) | 3.0 |

EXAMPLE 5

Water degummed soybean oil with the following characteristics is used:

| | |
|---|---|
| Acid number | 1.7 |
| Peroxide number | 7.1 |
| Anisidine number | 0.7 |
| Phosphorous content | 100 ppm |
| Iron content | 2.0 ppm |
| Copper content | 0.05 ppm |
| UV absorption (232 nm) | 3.2 |

This oil is continuously heated to 60° C. and fed to a tank provided with a stirrer and to which 10% aqueous citric acid solution is added. Based upon solid citric acid, 800 g of acidic acid is added for each 1000 kg of oil. The mixture is stirred for 15 minutes with slow stirring in the tank and then cooled to 30° C. Then 4% aqueous NaOH solution is added in an amount sufficient to neutralize the citric acid. The mixture is stirred slowly for 2 hours then suddenly heated to 80° C. and fed to a separator.

The oil thus resulting from the separation is washed with soft water in an amount of 10% and the washed oil is dried or subjected to further refining. The characteristics of the end product include:

| | |
|---|---|
| Acid number | 1.7 |
| Peroxide number | 7.8 |
| Anisidine number | 0.7 |
| Phosphorous content | 6.0 ppm |
| Iron content | 0.1 ppm |
| Copper content | 0.01 ppm |
| UV absorption (232 nm) | 3.4 |

EXAMPLE 6

Water degummed sunflower oil is used as the starting material and has the following characteristics:

| | |
|---|---|
| Acid number | 1.2 |
| Peroxide number | 6.0 |
| Anisidine number | 0.9 |
| Phosphorous content | 52 ppm |
| Iron content | 1.0 ppm |
| Copper content | 0.03 ppm |
| UV absorption (232 nm) | 3.0 |

-continued

| | |
|---|---|
| Wax content | 0.06% |

The oil is heated to 50° C. in a continuous process and supplied to a tank having a stirrer and to which 15% aqueous citric acid solution is added. 300 g of citric acid (solid) is used for each 1000 kg of the oil. The mixture is slowly stirred for 15 minutes and then cooled to 20° C. Then 4% aqueous NaOH solution in an amount for 100% stoichiometric neutralization of the acid value of the citric acid is supplied and the mixture slowly stirred for another 2 hours. The mixture is suddenly heated to 80° C. and supplied to a separator. The separated oil phase is washed with soft water and the washed oil is dried or subjected to further refining.

The characteristics of the product are:

| | |
|---|---|
| Acid number | 1.2 |
| Peroxide number | 6.0 |
| Anisidine number | 0.9 |
| Phosphorous content | 3.0 ppm |
| Iron content | 1.0 ppm |
| Copper content | 0.01 ppm |
| UV absorption (232 nm) | 3.0 |
| Wax content | 0.02% |

We claim:

1. A process for reducing a content of gum substances which are not hydratable with water and for optionally reducing the wax content of plant oils which comprises the steps of:

(a) adding to a plant oil containing gum substances not hydratable with water and wax substances, substantially 0.01 to 0.08% of a food acid or an acid anhydride of a food acid in a 5 to 15% solution thereof at a temperature of 20° to 70° C., intimately mixing the oil and said solution and causing said oil and said solution to remain in contact for a contact time in excess of 5 minutes with slow stirring;

(b) to a mixture formed in step (a) adding a 1 to 5% solution of a base at a temperature of 10° to 40° C. in an amount between 40 and 150% of the amount stoichiometrically required for neutralization to the acid added to said mixture in step (a) and effecting a reaction in the mixture for a period of 1 to 4 hours under slow stirring to effect coagulation of at least a major portion of said gum substances and optionally reducing a content of high melting triglycerides and wax substances in said mixture;

(c) rapidly and briefly heating the mixture formed in step (b) to separate an oil component from a component precipitated therefrom; and (d) optionally washing said oil component with a small quantity of water.

2. The process defined in claim 1 wherein step (b) is carried out for a reaction time of about 2 hours.

3. The process defined in claim 2 wherein the mixture of step (b) is stirred during said reaction time at a stirring rate of 20 to 40 revolutions per minute.

4. The process defined in claim 1 wherein said oil component is washed in step (d) of said small amount of water.

5. The process defined in claim 4 wherein said mixture of step (b) is rapidly and briefly heated in step (c) to 80° C.

6. The process defined in claim 1, further comprising controlling the temperature of the mixture from step (a) prior to addition of base in step (b) to provide a temperature of 8° to 10° C. prior to addition of base in step (b) for forced dewaxing of the mixture thereof.

7. The process defined in claim 1 wherein a slight excess of base is added to mixture of step (a) in step (b) to form a small quantity of a soap from free fatty acids or oil therein whereby soap micelles are formed for dewaxing of the oil.

8. The process defined in claim 1 wherein said plant oil is a raw nonwater degummed oil.

9. The process defined in claim 1 wherein said plant oil is a water degummed oil.

* * * * *